United States Patent [19]

Borsoi

[11] Patent Number: 4,523,395

[45] Date of Patent: Jun. 18, 1985

[54] ADJUSTING DEVICE PARTICULARLY FOR SKI BOOTS

[75] Inventor: Bruno Borsoi, Conegliano Veneto, Italy

[73] Assignee: Nordica S.p.A., Montebelluna, Italy

[21] Appl. No.: 408,539

[22] Filed: Aug. 16, 1982

[30] Foreign Application Priority Data

Aug. 31, 1981 [IT] Italy ..... 22770/81[U]

[51] Int. Cl.[3] ..... A43B 5/04

[52] U.S. Cl. ..... 36/119; 36/81; 74/520

[58] Field of Search ..... 36/117–122, 36/81; 74/89.15, 520

[56] References Cited

U.S. PATENT DOCUMENTS

| | | | |
|---|---|---|---|
| 2,323,827 | 7/1943 | Mason | 74/520 X |
| 3,713,231 | 1/1973 | Mochizuki | 36/121 |
| 3,729,841 | 5/1973 | Wagner | 36/118 |
| 3,828,448 | 8/1974 | Leonildo | 36/119 |
| 3,922,800 | 12/1975 | Miller et al. | 36/117 |
| 4,205,467 | 6/1980 | Salomon | 36/119 |

FOREIGN PATENT DOCUMENTS

| | | | |
|---|---|---|---|
| 2399811 | 3/1979 | France | 36/119 |

*Primary Examiner*—James Kee Chi

*Attorney, Agent, or Firm*—Guido Modiano; Albert Josif

[57] ABSTRACT

The device comprises a bar carried rotatably on the ski boot and provided with first and second oppositely threaded portions rotatively engaged by first and second blocks effective to translate along the bar. To the blocks there are articulated respective ends of first and second connecting rods, both thereof are articulated with their other ends to an adjuster.

4 Claims, 7 Drawing Figures

ADJUSTING DEVICE PARTICULARLY FOR SKI BOOTS

BACKGROUND OF THE INVENTION

This invention relates to an adjusting device particularly for ski boots.

As is known, a currently felt problem in the ski boot area of production is that of tailoring the ski boot itself, to afford for the user the faculty of adjusting as desired, in accordance with the peculiar morphology of his/her leg, the boot fit and the posture to take while skiing.

In an effort to overcome this problem, various devices have been proposed in the past which have a variety of different configurations, but have generally shown unpractical in use, since their operation is elaborate and difficult to carry out in a skier's environment.

Another drawback affecting conventional adjusting devices is that they are very complex construction-wise, and therefore liable to jam and go out of operation.

SUMMARY OF THE INVENTION

Thus the task of this invention is to remove such prior drawbacks by providing an adjusting device which is extremely versatile and can be mounted, depending on requirements, at different locations on a boot to permit a wide range of adjustments, while utilizing one and the same mechanism.

Whithin this task it is an object of the invention to provide a device which is constructionally simple, because made up of a limited number of component parts readily assembled together, and is so elementary in operation as to rule out any possible jamming thereof.

A further object of this invention is to provide an adjusting device which, by virtue of its inherent features, is highly reliable and safe to use.

An added object of the invention is that of providing a device which can be readily manufactured from commonly available materials and elements on the market, and which can be competitive from an economical standpoint.

According to one aspect of the present invention the above task and objects as well as yet other objects, such as will be more apparent hereinafter, are achieved by an adjusting device particularly for ski boots, characterized in that it comprises a bar carried rotatably on a ski boot and being operable from outside said boot, said bar having first and second oppositely threaded portions, with said portions there being rotatably engaged, respectively, first and second blocks translatable along said bar, to said blocks there being articulated one end, respectively, of at least a first connecting rod and at least a second connecting rod, both said rods being articulated with the other ends thereof to an adjuster.

BRIEF DESCRIPTION OF THE DRAWINGS

Further features and advantages will be more apparent from the following detailed description of an adjusting device particularly for ski boots, as illustrated by way of example and not of limitation in the accompanying drawings, where.

DESCRIPTION OF THE PREFERRED EMBODIMENT

Figure 1:
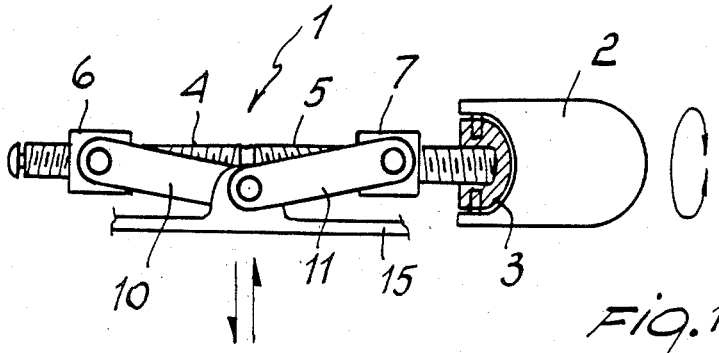
FIG. 1 is a schematical elevation view of the device according to the invention.
Figure 2:
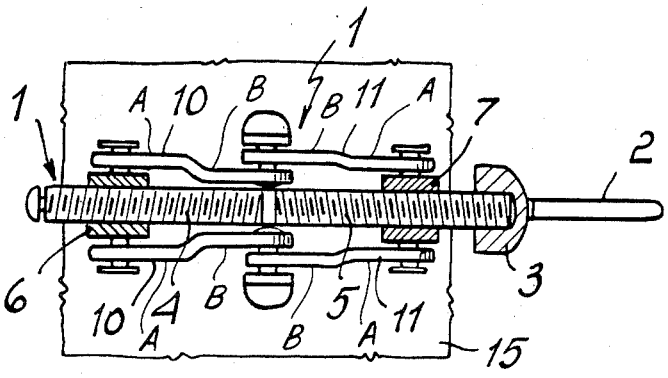
FIG. 2 is a top plan view of the device.

With reference to the cited figures, and in particular to FIGS. 1 and 2, the adjusting device according to the invention comprises a bar 1, which is carried rotatably inside a ski boot and operable from outside said boot thanks to the provision of a gripping element 2 which is articulated to a cap 3 secured, externally of the boot, to one end of the cited bar 1.

The bar 1 has first and second portions, respectively indicated at 4 and 5, which define in practice two halves thereof being oppositely threaded.

With the first portion 4 there engages rotatably a first block 6, whilst with the second portion 5 a second block 7 engages which define a threaded through hole therein having mating threads with the threads of the portion they are engaged with.

The resulting coupling allows the blocks 6 and 7 to translate mutually to and from along the bar 1 as the bar 1 is rotated.

To the cited block 6 there are articulated, laterally to the bar 1, a first pair of connecting rods 10, whilst to the second block 7, again laterally to the bar 1, there are articulated a second pair of connecting rods 11, which are hinged, with their free ends, to the connecting rods 10, such that the connecting rods 10 and connecting rods 11 are all hinged to an adjuster, schematically indicated at 15. In FIG. 2 it is to be noted that each of said connecting rods having a first portion, including the end articulated to one of said blocks, which is bent so as to be out-of-alignment with respect to the second portion including the other end of each of said connecting rods in order to rocking said connecting rods in a parallel plane at the axis of the articulations of said other ends of said connecting rods.

Owing to the couplings just described, it happens that, by translating the blocks 6 and 7 in either direction, the adjuster 15 is translated in either direction; it should be pointed out that, owing to the described coupling, the adjuster 15 is translated in a substantially perpendicular direction to the axial direction of the bar 1.

Figure 3:
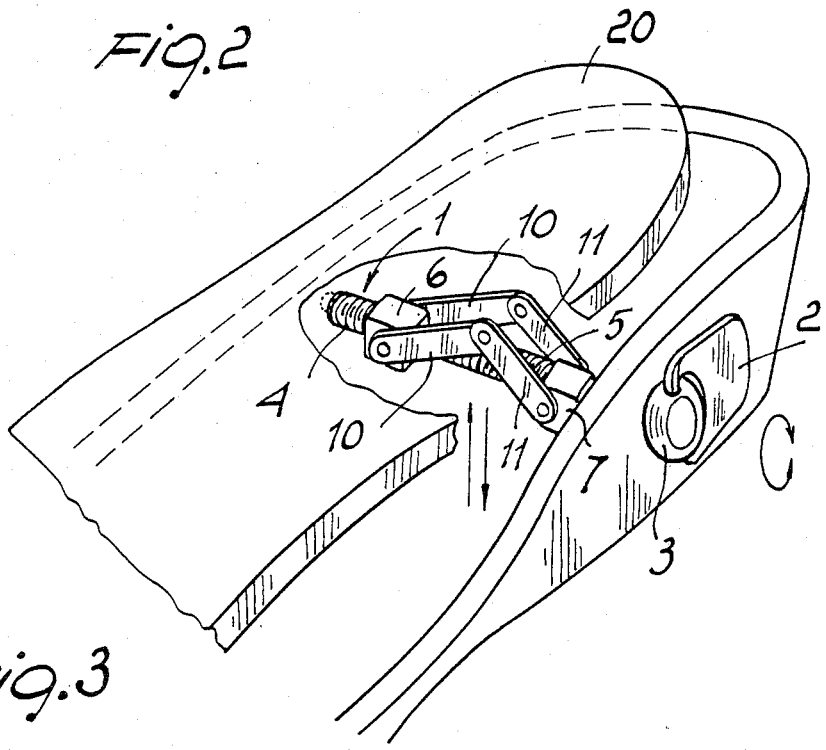
FIG. 3 is a partly cutaway schematical perspective view of this device as mounted to the heel region below the sole.

The adjusting device described hereinabove may have a wide range of applications inside the boot. Indeed, as shown for example in FIG. 3, the device may be mounted in the boot at the foot heel region below the sole 20, such that the actuation of the gripping tongue 2, accessible from the boot outside, allows the sole to be raised or lowered, according to the requirement of the individual skier, thus modifying the fit and achieving the best ratio of comfort to skiing performance.

Figure 4:
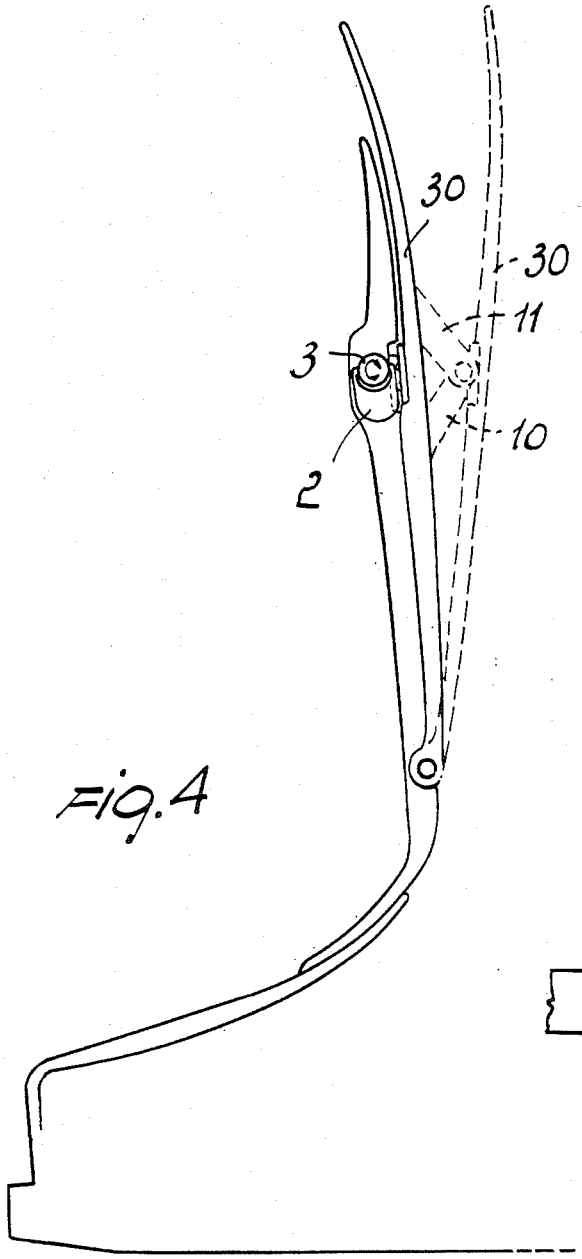
FIG. 4 shows the device as mounted at the front cuff area.
Figure 5:
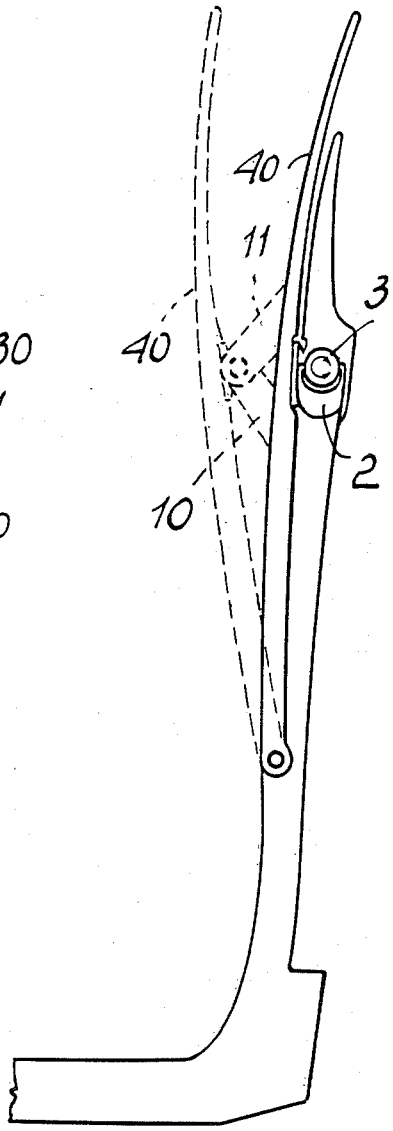
FIG. 5 shows the device as mounted at the rear cuff area.

Making reference to FIG. 4, the device is mounted by connecting the adjuster 15 to a front portion of the boot leg portion, indicated at 30, thereby the user is enabled to adjust the front lean; similarly in FIG. 5, the adjuster is shown connected to a rear leg portion 40, to provide in this case too for adjustability of the rearward lean.

Figure 6:
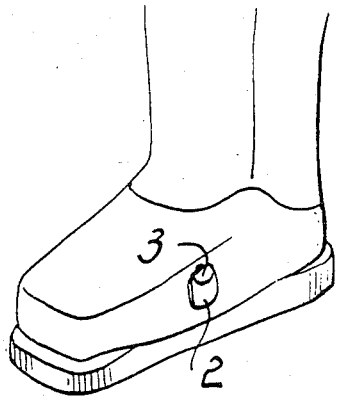
FIG. 6 shows schematically a boot incorporating the adjusting device of this invention, which is mounted at the foot neck region.
Figure 7:
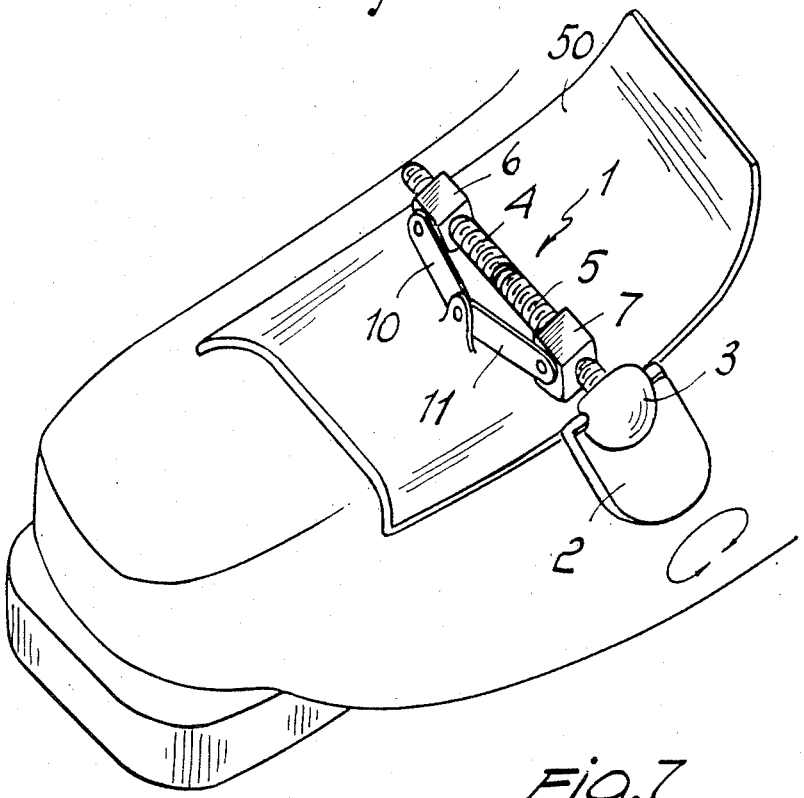
FIG. 7 shows the device mounted at the foot neck region for adjusting the fit.

With reference to FIGS. 6 and 7, the cited adjuster comprises a pusher 50 located inside the boot at the foot neck region, such that by operating the device the user can adjust at will the boot fit, again by manipulating the gripping element 2, which is made accessible from outside the boot.

It will be appreciated from the foregoing that the invention achieves its objects, and in particular that the device described hereinabove has an extremely simple construction, in that it is comprised in practice merely of a threaded bar with blocks arranged to slide in opposite directions along the bar itself, which enable, through the connection to connecting rods, the position taken by the adjuster to be changed, which adjuster may have any configuration, depending on the installation point of the device inside the boot.

It will be obvious for the expert in the art that this device is susceptible to a wide range of choices for its installation within a boot, since the same results may be obtained by also installing the device at other locations on the boot, and in all cases at all those locations where it is necessary to change the inside configuration of the boot to better match the morphology of the foot or leg of its user and the various postures to be taken in skiing.

In practicing the invention, the materials used, if compatible with the specific application, and the dimensions and contingent shapes may be any ones suitable for the intended applications.

I claim:

1. An adjusting device for ski boots comprising:

a bar carried rotatably on a ski boot and operable from outside said ski boot;

a cap rigidly connected to one end of said bar externally to said ski boot;

a gripping element being articulated to said cap for hand rotating said bar about its own axis;

said bar having first and second oppositely threaded portions;

a first and second block having in the inside thereof a threaded though hole having a thread matching the portion of said bar, which they engage said first and second blocks travelling along said bar, in opposite direction;

said first and second blocks respectively engaging rotatably with said oppositely threaded portions during the rotation of said bar about its own axis;

a first pair of connecting rods arranged laterally to said bar;

a second pair of connecting rods arranged laterally to said bar in opposed positions with respect to said first pair, and located on said boot to the foot heel region;

each of said connecting rods having one end articulated to said blocks respectively;

an adjuster including the sole of said ski boot and engaging the other ends of said connecting rods;

said first and second pair of connecting rods being articulated to each other at the end engaging with said adjuster;

said first and second pair of connecting rods respectively lying in a plane perpendicular to said adjuster and substantially coincident with the plane coinciding with the sides of said first and second blocks;

said first and second blocks translating along said bar for moving said adjuster in a perpendicular direction to the axial direction of said bar by rotation of said bar about its own axis;

each of said connecting rods having a first portion, including said one end articulated to one of said blocks, which is bent so as to be out-of-alignment with respect to the second portion including the other end of each of said connecting rods;

said connecting rods being arranged for rotating parallel plane with respect to the axis of said bar and said plane which is perpendicular to the axis of the articulations of said other ends of said connecting rods.

2. An adjusting device particularly for ski boots, as claimed in claim 1, wherein:

it is located at the front area of the cuff of said ski boot, said adjuster including the front leg portion of said boot.

3. An adjusting device particularly for ski boots, as claimed in claim 1, wherein:

it is located at the rear area of the cuff, said adjuster including the rear cuff.

4. An adjusting device particularly for ski boots, as claimed in claim 1, wherein:

it is located inside said ski boot at the foot region, said adjuster including a pusher engageable with the user's foot neck.

* * * * *